US008726827B1

(12) United States Patent
Eriksen

(10) Patent No.: US 8,726,827 B1
(45) **Date of Patent: *May 20, 2014**

(54) SYSTEMS AND METHODS FOR COMPENSATING FOR COMPRESSIBILITY AND THERMAL EXPANSION COEFFICIENT MISMATCH IN BUOYANCY CONTROLLED UNDERWATER VEHICLES

(71) Applicant: University of Washington Center for Commercialization, Seattle, WA (US)

(72) Inventor: Charles C. Eriksen, Seattle, WA (US)

(73) Assignee: University of Washington Center for Commercialization, Seattle, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/775,083

(22) Filed: Feb. 22, 2013

Related U.S. Application Data

(63) Continuation of application No. 12/792,620, filed on Jun. 2, 2010, now Pat. No. 8,381,672.

(60) Provisional application No. 61/217,657, filed on Jun. 2, 2009.

(51) Int. Cl.
*B63G 8/22* (2006.01)

(52) U.S. Cl.
USPC ..... 114/333; 114/125; 441/29

(58) Field of Classification Search
USPC ..... 114/124, 125, 315, 331, 333, 338; 441/6, 7, 11, 21, 28, 29; 623/8
See application file for complete search history.

(56) References Cited

U.S. PATENT DOCUMENTS

| | | | | |
|---|---|---|---|---|
| 4,100,627 | A * | 7/1978 | Brill, III | 623/8 |
| 5,235,931 | A * | 8/1993 | Nadolink | 114/333 |
| 6,544,088 | B1 * | 4/2003 | Dubois | 441/6 |
| 8,381,672 | B1 * | 2/2013 | Eriksen | 114/333 |

* cited by examiner

*Primary Examiner* — Lars A Olson

(57) ABSTRACT

Systems and methods for compensating for compressibility and thermal expansion coefficient mismatch in buoyancy controlled or buoyancy-driven underwater vehicles are disclosed herein. An underwater vehicle configured in accordance with one embodiment of the disclosure, for example, can include a hull and a compartment carried by the hull and at least partially flooded with a first liquid having similar properties as a surrounding liquid into which the hull is configured to be deployed. The first liquid has a first compressibility and thermal expansion coefficient. The underwater vehicle can further include a compressibility and thermal expansion coefficient compensation system comprising a container filled or at least partially filled with a compressible liquid comprising silicone in the compartment. The compressible liquid has a second compressibility higher than the first compressibility and second thermal expansion coefficient higher than the first thermal expansion coefficient. The compressible liquid can include, for example, hexamethyldisiloxane (HMDS).

20 Claims, 5 Drawing Sheets

SYSTEMS AND METHODS FOR COMPENSATING FOR COMPRESSIBILITY AND THERMAL EXPANSION COEFFICIENT MISMATCH IN BUOYANCY CONTROLLED UNDERWATER VEHICLES

CROSS-REFERENCE TO RELATED APPLICATIONS

This application is a continuation of U.S. patent application Ser. No. 12/792,620, filed on Jun. 2, 2010, which claims priority to U.S. Provisional Patent Application No. 61/217,657, filed Jun. 2, 2009, each of which is incorporated herein by reference in its entirety.

STATEMENT REGARDING FEDERALLY SPONSORED RESEARCH OR DEVELOPMENT

This invention was made with government support under U.S. Navy Office of Naval Research Contract No. N000140810734. The government has certain rights in the invention.

TECHNICAL FIELD

The disclosed technology relates generally to compressible liquids and, in particular, to systems and methods for compensating for compressibility mismatch in buoyancy controlled underwater vehicles.

BACKGROUND

Underwater vehicles or devices using buoyancy control are currently used in oceans, lakes, and other bodies of water throughout the world to perform research, monitoring, and a variety of other tasks. Such vehicles generally cost significantly less to operate than large research ships for performing these tasks, while generally providing at least the same or better results. Buoyancy control systems can be used to guide these underwater vehicles to different depths and to maintain given depths within the respective ocean and/or lake. When using such systems, underwater vehicles must perform work (i.e., expend energy) in order to buoyantly ascend through water stratified in density as a result of temperature and/or salinity. For example, the range of seawater density variation arising from the natural oceanic range of temperature and salinity in the open ocean is less than 1%. A greater amount of energy must be expended to overcome water density differences induced by pressure when the underwater vehicle is less compressible (i.e., stiffer) than water. For example, the range of seawater density variation due to a pressure change from the sea surface to the sea floor in the open, deep ocean (e.g., 5-6 km depth) is approximately 2-3%.

Underwater vehicles or devices are generally fabricated from solid materials (e.g., metal, ceramic, or fiber/resin composites). Such vehicles are stiffer than and compress approximately half as much as seawater. Therefore, the energy required for underwater vehicles to ascend through the ocean can easily be dominated by the compressibility mismatch contribution to buoyancy. The same is true for shallow-diving vehicles in waters stratified by temperature and/or salinity. Compensation for a compressibility mismatch can be accomplished by incorporating a compliant part in a vehicle. For example, a pressure hull surrounding a spring-backed piston having a neutrally compressible float that tracks a parcel of seawater as it changes depth through ocean circulation can be used to closely match overall vehicle compressibility to the compressibility of seawater. Vehicles including spring-backed piston devices, however, are typically complex, expensive, and cumbersome.

DETAILED DESCRIPTION

The present disclosure is directed to systems and methods for compensating for compressibility mismatch in buoyancy controlled or buoyancy driven underwater vehicles. Certain specific details are set forth in the following description and in FIGS. 1-5 to provide a thorough understanding of various embodiments of the disclosure. For example, embodiments of autonomous underwater vehicles (AUVs) having compressibility compensation systems are described in detail below. The disclosed technology, however, may be used in a variety of different underwater vehicles or vessels including, but not limited to, gliders, dropsondes, platforms, moored profilers, or other suitable unmanned or manned underwater vehicles or vessels. Additionally, the term "seawater" is used herein to describe a fluid in which the underwater vehicle is immersed or deployed. It will be appreciated, however, that the underwater vehicles or vessels may be immersed or deployed in fresh water or other fluids.

Well-known structures, systems, and methods often associated with such systems have not been shown or described in detail to avoid unnecessarily obscuring the description of the various embodiments of the disclosure. In addition, those of ordinary skill in the relevant art will understand that additional embodiments of the new technology may be practiced without several of the details described below.

Figure 1:
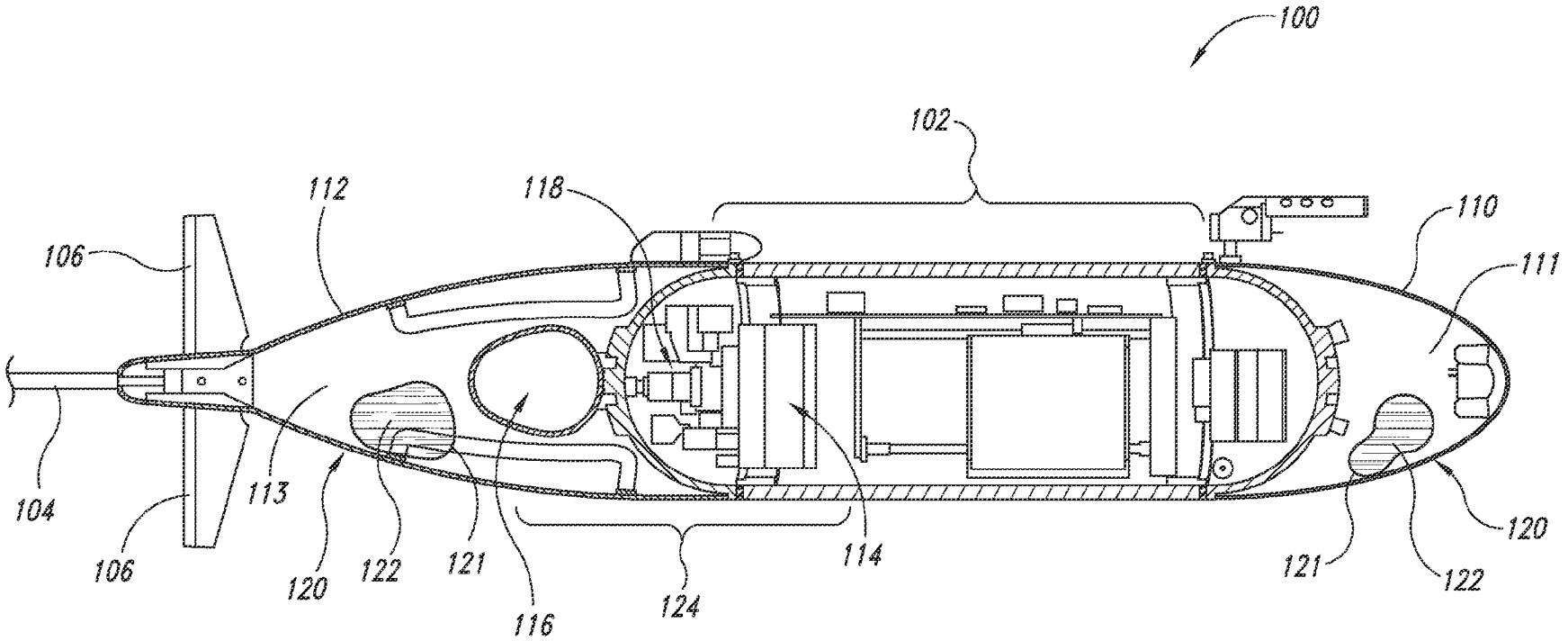
FIG. 1 is a partially cut-away top plan view of a buoyancy-driven underwater vehicle configured in accordance with an embodiment of the disclosure.

FIG. 1 is a partially cut-away top plan view of a buoyancy-driven AUV 100 configured in accordance with an embodiment of the disclosure. The AUV 100 of FIG. 1 is a glider including a pressure hull 102 enclosed by a first or forward fairing 110 and a second or aft fairing 112. An antenna 104, one or more rudders 106, and wings (not shown) can be attached to the forward fairing 110 and/or aft fairing 112. The forward and aft fairings 110 and 112 include inner volumes 111 and 113, respectively, configured to be at least partially flooded with a surrounding fluid (e.g., seawater). Alternatively, the fairings 110 and 112 can be flooded with liquid having similar characteristics as the liquid in which the AUV 100 is immersed or deployed (e.g., fresh water, etc.).

The AUV 100 further includes a compressibility compensation system 120 configured to compensate for buoyancy differences that arise from a mismatch between the AUV's compressibility and seawater during operation. The compressibility compensation system 120 includes one or more containers 121 within the forward fairing 110 and/or the aft fairing 112. The container(s) 121 can be flexible, pliable containers or bladders having arbitrary shapes. In other embodiments, however, the container(s) 121 can be generally rigid. Although only two containers 121 are shown, it will be appreciated that the compressibility compensation system 120 can include a different number of containers 121 in the forward fairing 110 and/or the aft fairing 112. Further details regarding the compressibility compensation system 120 are described below.

The pressure hull 102, the forward fairing 110, and the aft fairing 112 can be shaped to minimize drag during operation. The pressure hull 102 can be made out of carbon fiber, metal, or another suitable material, while the forward and aft fairings 110 and 112 can be made out of fiberglass or other suitable materials. In still other embodiments, the pressure hull 102 and fairings 110 and 112 may be composed of the same material. Additionally, the forward fairing 110 and/or the aft fairing 112 may have an elliptical ogive shape or another suitable hydrodynamic shape. In still further embodiments, the AUV 100 may have one fairing, additional fairings, and/or one or more additional flooded inner volumes.

The AUV 100 also includes a buoyancy control system 124 configured to guide the AUV 100 to different depths or help the AUV 100 maintain a given depth during operation. The buoyancy control system 124 in the illustrated embodiment comprises an internal hydraulic reservoir 114 within the pressure hull 102, an external hydraulic accumulator 116 within the aft fairing 112, and a pump 118 configured to move a liquid (e.g., oil) between the reservoir 114 and the accumulator 116 to change the buoyancy of the AUV 100. The accumulator 116, for example, can be a bladder or another suitable device that is suspended in the fluid in the flooded aft fairing portion 112. Further details regarding the buoyancy control system 124 and operation of this system are described below with reference to FIG. 3. In other embodiments, the buoyancy control system 124 can include different features and/or have a different arrangement. Alternatively, other suitable buoyancy control systems may be used with the AUV 100.

In the embodiment shown in FIG. 1, the pressure hull 102 is sealed from the forward and aft fairings 110 and 112, and the pressure hull 102 includes a battery pack and data gathering devices including a global positioning system, a storage device (e.g., FLASH memory), and sensors such as a temperature-conductivity-dissolved oxygen sensor, a fluorometer-optical backscatter sensor, and other suitable devices. Further, the antenna 104 is configured to transmit and/or receive signals (e.g., GPS fixes, data measurements, commands) from a satellite or other remote device when the AUV 100 reaches the surface or substantially nears the surface during operation. In other embodiments, the AUV 100 can include different components and/or the components can have a different arrangement.

As is known to those of ordinary skill the art, buoyancy is an upward acting force caused by fluid pressure. Archimedes principle states that buoyancy is equivalent to the weight of displaced fluid. Accordingly, objects of fixed mass can control buoyancy by changing the volume of the medium they displace. By reducing displacement volume sufficiently, buoyancy can be made negative, such that an object will fall. As an object falls to a greater depth, however, hydrostatic pressure increases. Increased hydrostatic pressure compresses both the object and the surrounding fluid, but usually at different rates. Compressibility is the measure of relative volume change of a substance as a response to a change in pressure. If an object is stiffer (i.e., low compressibility) than a surrounding fluid medium, the object will become more buoyant as it drops to deeper depths (i.e., higher pressure), thereby slowing the descent of the object and requiring work to be done to decrease buoyancy. If an object falls deep enough that the object's buoyancy is increased from a negative to a neutral value, the surrounding fluid medium has compressed sufficiently so that the fluid's mass density matches that of the object, and the object is stabilized at that depth. In order for the object to rise buoyantly, its displacement volume must be increased, which requires work to be performed. A compressibility mismatch between an object and the surrounding fluid causes the object having low compressibility to become ever less buoyant as it rises, thereby slowing the ascent and requiring work to be done to increase buoyancy.

As mentioned above, the compressibility compensation system 120 includes one or more flexible, compliant containers 121 that are at least partially filled with a compressible liquid 122, such as a silicone liquid, that gives the AUV 100 substantially the same compressibility as the surrounding seawater. The combination of the compliant container 121 and the volume of compressible liquid 122 within the container 121 are referred to herein as a "compressee." In one embodiment, silicone fluids classified as polydimethylsiloxanes (PMDSs) can be used within the container 121 because they are generally more compressible than seawater and, therefore, increase the compressibility of the less compressible AUV 100. In one particular embodiment, for example, the PMDS compound hexamethyldisloxane (HMDS) or $[(CH_3)_3Si]_2O)]$ can be used within the container 121. One feature of HMDS is that it is approximately three to five times more compressible than seawater. For example, at temperatures near 5° C., HMDS compresses by approximately 6.5% from the sea surface to 6 km in depth (about 1-6000 dbar pressure). In contrast, seawater compresses only approximately 2.5% and underwater vehicles compress even less (approximately 1% to 1.5% over the same range). Therefore, a compressee including a proportionally small amount of HMDS within the container 121 can increase the compressibility of the AUV 100 to substantially match the compressibility of seawater. In other embodiments, however, other suitable silicone fluids and/or other suitable compressible fluids can be used. It will be appreciated that although a number of polymers are relatively more compressible than seawater, many such polymers are fuels, making them unsuitable for use with the compressibility compensation system 120. Perfluorocarbon compounds are also highly compressible, but are typically denser than seawater (requiring extra flotation devices on the underwater vehicle), expensive, and potentially harmful to the environment.

One feature of a compressee including silicone liquids (e.g., PDMSs) is that PDMSs are highly compressible compared to water. As such, they add to vehicle buoyancy by being less dense than water, and the size of the compressee only needs to be a small fraction of the overall vehicle volume displacement. Additionally, PDMSs can pack easily into spaces of arbitrary shape as contained liquids, and are readily contained by and not corrosive to flexible plastics. Still other features of PDMSs are that they are commercially available at a modest cost and are classified as Volatile Organic Compound (VOC) Exempt.

Another feature of a compressee including silicone liquids is that such liquids have a higher thermal expansion than the surrounding seawater. For example, HMDS has a coefficient of thermal expansion of $1.3\times10^{-3}$/° C., whereas seawater has a coefficient of thermal expansion around $1.7\times10^{-4}$/° C., nearly a factor of ten smaller. The incorporation of a liquid with higher thermal expansion decreases the work required for an underwater vehicle (e.g., AUV 100) to cross the natural thermal stratification of the surrounding water. The compressee's thermal expansion difference from seawater is especially useful for underwater vehicles making shallow dives because thermal stratification is generally more pronounced closer to the sea surface.

Figure 2:
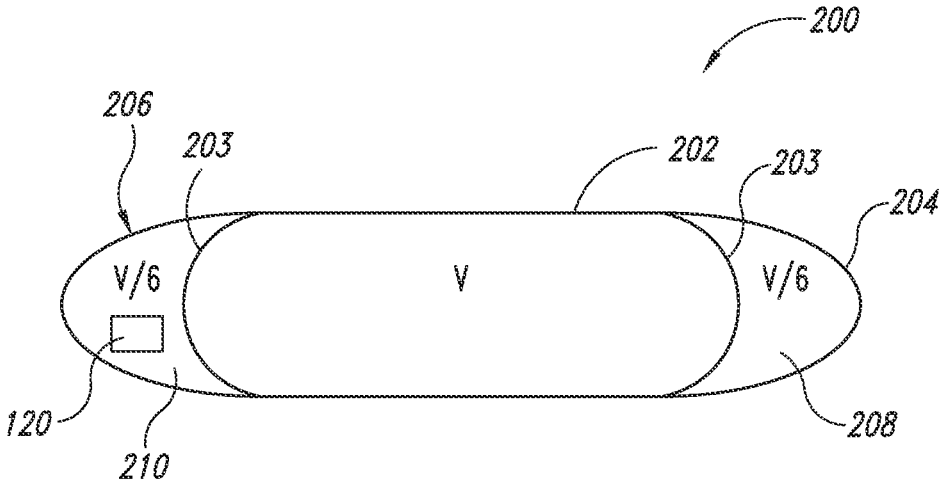
FIG. 2 is a schematic, cross-sectional top plan view of a buoyancy-driven underwater vehicle configured in accordance with an embodiment of the disclosure.

FIG. 2 is a schematic, cross-sectional top plan view of a buoyancy-driven autonomous underwater vehicle 200 configured in accordance with an embodiment of the disclosure. The AUV 200 can include a number of features generally similar or identical to the AUV 100 described above with reference to FIG. 1, and can contain many of the various components described above in detail with reference to FIG. 1. For example, the AUV 200 includes an inner pressure hull or cylindrical body 202 comprised of a cylindrical section capped by generally hemispherical end caps 203. Appended fairings 204 and 206 can have a generally elliptical or ogive shape similar to the forward and aft fairings 110 and 112 of the AUV 100 of FIG. 1, or another suitable shape designed to reduce the drag of the AUV 200. The surfaces of the fairings 204 and 206 and the pressure hull 202 define compartments 208 and 210, respectively, that are flooded with the fluid in which the AUV 200 is immersed or deployed (e.g., seawater, liquid having similar properties to seawater, etc.). At least one of the compartments 208 or 210 can include the compressibility compensation system 120 (shown schematically). Although the system 120 is only shown in the compartment 210, it will be appreciated that the other compartment 208 may contain an additional compressibility compensation system 120 and/or may contain other sensor devices requiring contact with the surrounding environment. Further, the AUV 200 can include a number of additional compartments that may house additional compressibility compensation systems 120.

The proportional size of the compartments 208 and 210 to the volume of the AUV 200 can be calculated to ensure the compressibility compensation system 120 is the appropriate size using the following equation:

$$\frac{V_C}{V} = \frac{(K_S - K_V) - \frac{dT}{dP}(\alpha_S - \alpha_V)}{(K_C - K_S) - \frac{dT}{dP}(\alpha_C - \alpha_S)}$$

In this equation $K_V$, $K_C$, $K_S$ and $\alpha_V$, $\alpha_C$, $\alpha_S$ are the compressibilities and effective thermal expansion coefficients for the vehicle hull, liquid compressee, and seawater, respectively, and dT/dP is the rate of temperature change with pressure of the environment in which the vehicle operates (e.g. the natural temperature stratification of the ocean) and V is the vehicle hull volume. This equation specifies the volume of compressee $V_C$ for which effects of compressibility mismatch and thermal expansion differences between the vehicle and seawater will be neutralized. Since neither compressibility, thermal expansion, nor environmental temperature gradient are strictly constant over a range of pressure and temperature, compressibility mismatch and thermal expansion compensation is generally approximate. For example, a compressibility mismatch between a vehicle and a surrounding fluid leads to a displace volume difference $p(K_S-K_V)V$ over a pressure increment p that induces the volume difference. For a compressee to compensate this difference, it must undergo an equivalent relative volume change $p(K_C-K_S)V_C$. With water as the surrounding fluid, $K_S$ is approximately $4\times10^{-6}$/dbar and vehicle compressibility $K_V$ is about half as much. The compressibility of HMDS, $K_C$, averages approximately $1.2\times10^{-5}$/dbar from the sea surface to 6 km depth at oceanic temperatures. Therefore, the ratio of HMDS volume to uncompensated vehicle volume $V_C/V$ in the absence of thermal change is approximately ¼. Thus, if HMDS is used as the liquid within the compressee, the total vehicle size needs to increase by approximately one quarter its size for the compressee-appended underwater vehicle to be naturally compressible in the ocean. In the presence of a thermal gradient dT/dP, the ratio $V_C/V$ for both pressure and thermal compensation is considerably reduced, since $(\alpha_S-\alpha_V)/(\alpha_C-\alpha_S)$ is a ratio considerably less than one.

In the embodiment shown in FIG. 2, the increase in vehicle size due to the compressibility compensation system 120 is inconsequential since the generally elliptical ogive shape of the compartments 208 and 210 reduces hydrodynamic drag compared to the drag created by the cylindrical body's 202 hemispherical ends. Additionally, the flooded compartments 208 and 210 are already generally used on cylindrical bodies (e.g., pressure hulls) for the buoyancy control systems, so the AUV 200 does not necessarily need to increase size. Instead, the AUV 200 can easily accommodate the compressibility compensation system 120 in the pre-existing fairings. Moreover, the compressibility compensation system 120 is expected to increase the AUV's packaging efficiency. For example, since the compressee(s) of the system 120 are buoyant, more payload mass in the form of other components can be added to the AUV 200.

Figure 3:
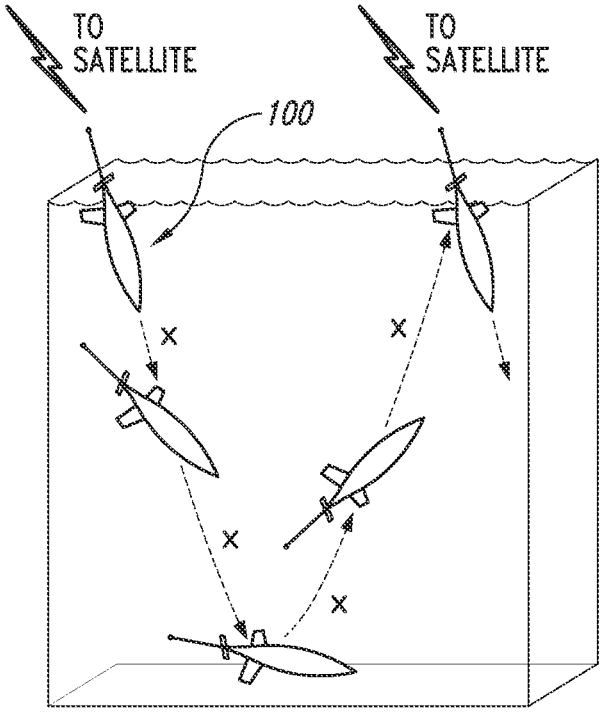
FIG. 3 is a schematic illustration of the buoyancy-driven underwater vehicle of FIG. 1 in operation.

FIG. 3 is a schematic illustration of the buoyancy-driven underwater vehicle 100 of FIG. 1 in operation. More specifically, FIG. 3 illustrates a trajectory of the vehicle 100 as it dives and then ascends via the buoyancy control system. In some embodiments, the dive cycle along the trajectory X can last from a fraction of an hour to a fraction of a day. In other embodiments, however, the dive cycle can last more than a day.

Referring to FIGS. 1 and 3 together, the buoyancy control system of the AUV 100 is configured to change the volume of the fixed-mass AUV 100 to move the AUV along a trajectory X. As best seen in FIG. 1, the buoyancy control system includes the hydraulic reservoir 114 within the pressure hull 102 and spaced apart from the flooded aft fairing 112 containing the external accumulator 116. The reservoir 114 can be a constant area reservoir that allows precise measurements of the volume of the liquid it contains in order to determine distance. Oil or another suitable material can be used fill the reservoir 114.

Referring back to FIGS. 1 and 3 together, to begin the AUV's descent along the trajectory X, the reservoir 114 is filled with oil to make the AUV 100 less buoyant. Attitude can be controlled by moving a mass (e.g., a battery pack) inside the pressure hull 102 and wings (not shown) can provide hydrodynamic lift to propel the vehicle forward as it sinks or rises. Once the AUV 100 reaches its desired depth, the pump 118 moves the oil from the reservoir 114 to the external accumulator 116. Inflating the accumulator 116 increases the AUV's volume displacement to make the AUV 100 more buoyant, so it can climb or ascend to the surface along the trajectory X.

One feature of the compressibility compensation system 120 is that the AUV 100 requires considerably less energy to operate as compared with conventional buoyancy-driven underwater vehicles. As described above, the compressibility compensation system 120 passively compensates for volume displacement differences induced by compressibility mismatches between the AUV 100 and the surrounding seawater.

Accordingly, since the buoyancy control system needs to perform little or no work to compensate for compressibility and thermal expansion mismatches, the buoyancy control system can apply most of its energy (e.g., provided by a battery pack, such as a lithium battery) toward thrust moving the AUV 100 along the trajectory X. This significant energy savings can enable the AUV 100 to operate more efficiently and for longer periods of time or to allow for more energy to be applied to non-propulsive tasks such as operating instrumentation. In one particular embodiment, for example, a compressee of HMDS comprising approximately 17% of the total displacement volume of the AUV 100 can approximately double the endurance of the AUV 100 without a new or recharged power source (e.g., battery).

Figure 4A:
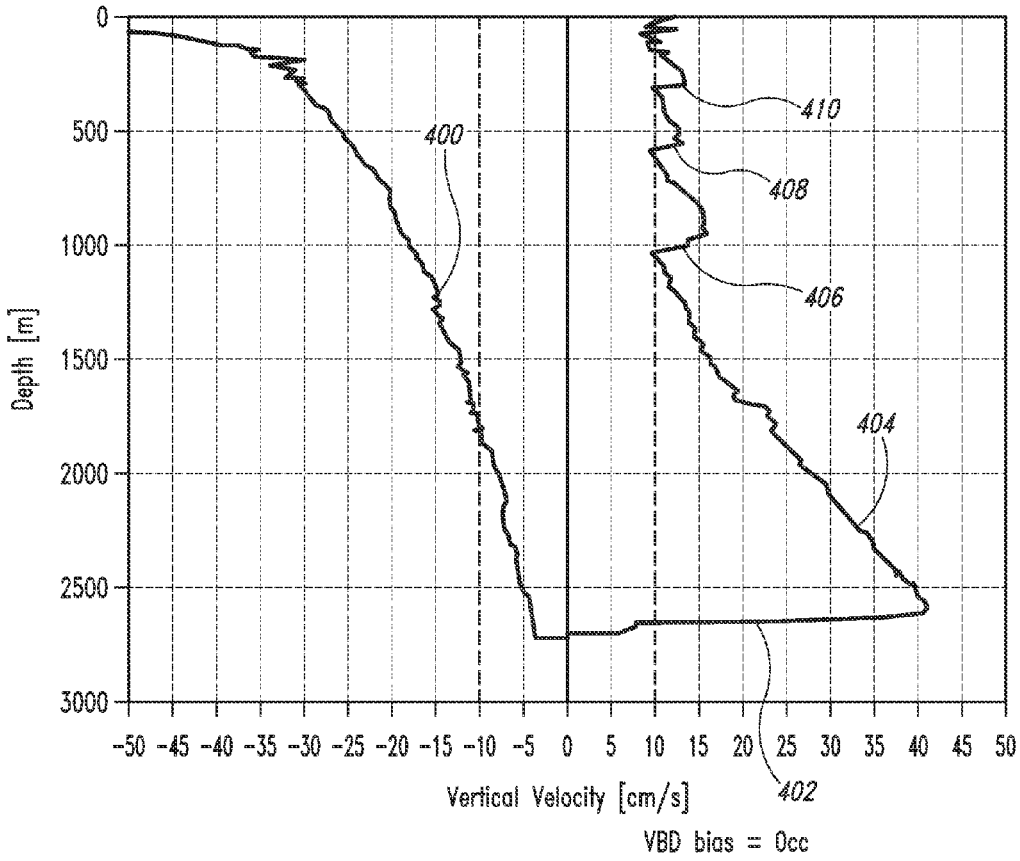
FIG. 4A is a velocity-depth graph of a buoyancy-driven underwater vehicle that does not include the new technology.
Figure 4B:
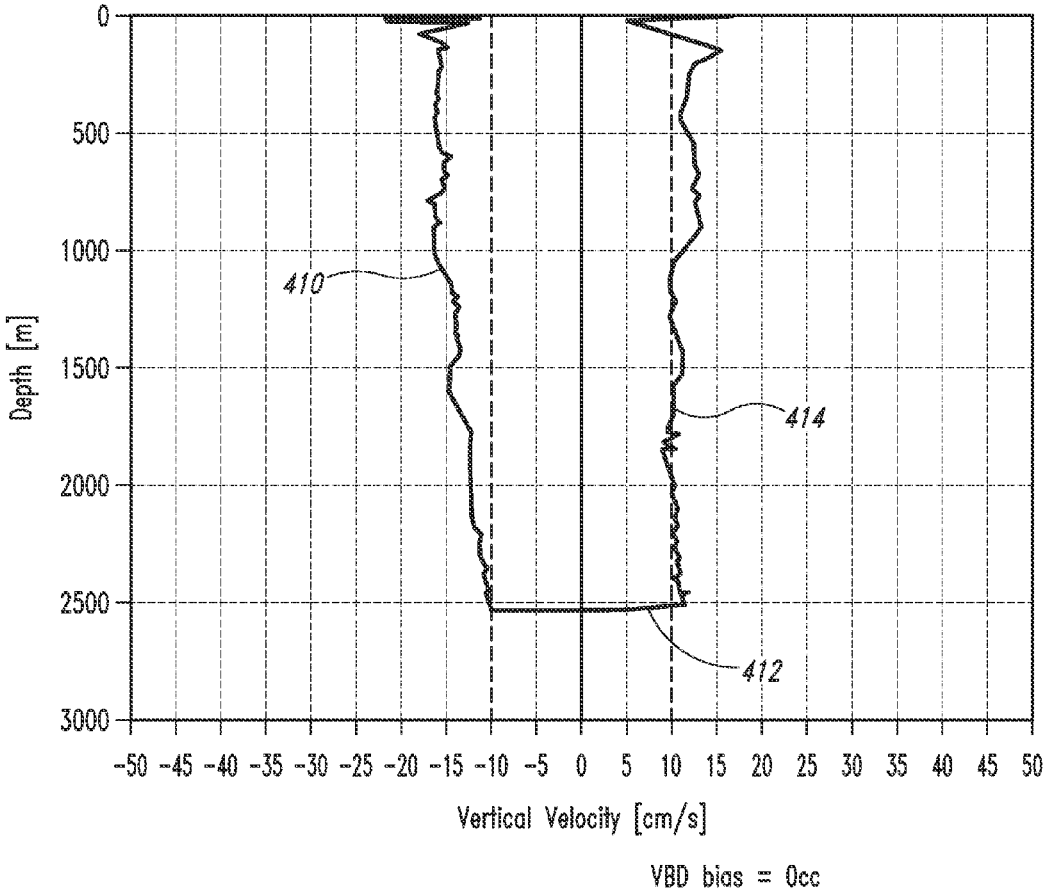
FIG. 4B is a velocity-depth graph of a buoyancy-driven underwater vehicle including a compressibility compensation system configured in accordance with an embodiment of the disclosure

FIG. 4A is a velocity-depth graph of a buoyancy-driven underwater vehicle that does not include the new technology, and FIG. 4B is a velocity-depth graph of a buoyancy-driven underwater vehicle including a compressibility compensation system configured in accordance with an embodiment of the disclosure. The two graphs visually demonstrate the improvements in efficiency as a result of using a compressibility compensation system configured in accordance with this disclosure. Referring first to FIG. 4A, an underwater vehicle without the compressibility compensation system gradually decreases velocity as depth increases (as shown by curve 400) due to an increase in buoyancy of the underwater vehicle with increased pressure. At the deepest depth (approximately 2,750 meters in FIG. 4A), the underwater vehicle has nearly neutral buoyancy, despite having started its descent with considerable negative buoyancy at the sea surface. The buoyancy control system (described above with reference to FIGS. 1 and 3) then performs work to increase the buoyancy of the underwater vehicle (e.g., pump oil from an interior reservoir to the exterior accumulator) to begin its ascent (as shown by line 402). Once the buoyancy of the underwater vehicle is positive, the underwater vehicle rises, but at successively slower rates with decreasing depth (as shown by curve 404) until the buoyancy pump repeatedly acts to increase positive buoyancy during ascent (shown by jog lines 406, 408, and 410). The buoyancy control system must perform work throughout the ascent each time the underwater vehicle loses sufficient positive buoyancy to slow its upward progress. The loss of positive buoyancy on ascent occurs at least partially due to lack of compensation for the compressibility mismatch between the stiffer underwater vehicle and the surrounding water. Such work performed by the buoyancy control system to maintain speed requires a significant amount of battery energy and reduces the number of dive cycles the vehicle can otherwise perform without a new or recharged battery.

FIG. 4B graphically illustrates the improvements in operational efficiency of the underwater vehicle due to a compressibility compensation system configured in accordance an embodiment of the disclosure. In particular, as shown by curve 410, the underwater vehicle descends at an almost constant rate. At the deepest depth (approximately 2,500 meters in FIG. 4B), the buoyancy control system again performs work to increase buoyancy of the vehicle to initiate ascent (as shown by line 412). In this case, however, the work expended is significantly less than that of the vehicle described above with reference to FIG. 4A because the compressibility compensation system obviates the need to repeatedly increase buoyancy. The loss of buoyancy with decreased depth (as shown by curve 414) is significantly decreased as compared with that of the vehicle described above with reference to FIG. 4A since the compressibility compensation system neutralizes the underwater vehicle's compressibility mismatch, enabling the ascent rate to remain nearly constant (as shown by curve 414). It will be appreciated that the graphs of FIGS. 4A and 4B illustrate only one specific embodiment of the disclosure, and underwater vehicles having a compressibility compensation system configured in accordance with other embodiments of the disclosure may travel to different depths and/or at different velocities.

Figure 5:
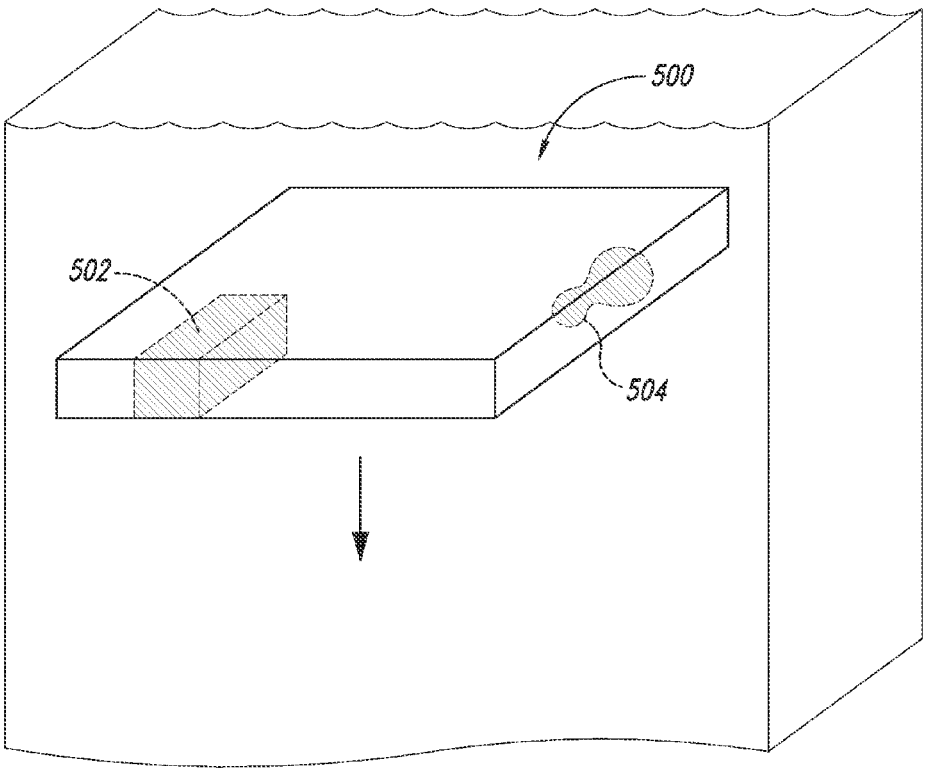
FIG. 5 is a partially schematic, isometric view of a buoyancy-controlled underwater vehicle configured in accordance with another embodiment of the disclosure.

FIG. 5 is a partially schematic, isometric view of a buoyancy controlled underwater vehicle configured in accordance with another embodiment of the disclosure. More specifically, FIG. 5 illustrates a profiling float 500 having a buoyancy control system 502 (shown schematically) configured to move or ascend the float 500 to the surface of a body of water where it can communicate and receives navigation fixes or other information, and then return the float 500 to a neutrally buoyant depth. The profiling float 500 also includes a compressibility compensation system 504 configured in accordance with an embodiment of the disclosure. The compressibility compensation system 504 can include, for example, a compressee having a flexible container (e.g., plastic, pliable sack or bladder) at least partially filled with a liquid silicon material (e.g., HMDS) and can be carried anywhere on the profiling float 500 that is exposed to the surrounding liquid (e.g., seawater) or a liquid having substantially similar characteristics as the surrounding liquid.

Traditional profiling floats use about half their battery energy to effect ascent, and about half of that energy, in turn, is typically devoted to overcoming the volume displacement induced by the compressibility mismatch. Use of the compressibility compensation system 504, however, is expected to extend the life of the profiling float 500 by over 30%. These energy savings can be applied to operate instruments, enable the float 500 to dive deeper, etc. Additionally, the modest increase in the profiling float's size necessary to accommodate the compressibility compensation system 504 is smaller and less complicated than that for gliders since hydrodynamic drag is not an important factor. In some embodiments of the profiling float 500, drop weights (not shown) can be used to provide negative buoyancy during descent rather than a pumping system. The use of the compressees described above can regulate the descent speed of the float 500 by effectively neutralizing the compressibility mismatch.

From the foregoing, it will be appreciated that specific embodiments of the disclosure have been described herein for purposes of illustration, but that various modifications may be made without deviating from the spirit and scope of the disclosure. For example, as mentioned previously, compressibility compensation systems configured in accordance with this disclosure can be used in moored profilers, platforms, dropsondes, and/or a variety of other underwater vehicles or vessels. Aspects of the disclosure described in the context of particular embodiments may be combined or eliminated in other embodiments. Further, while advantages associated with certain embodiments of the disclosure have been described in the context of those embodiments, other embodiments may also exhibit such advantages, and not all embodiments need necessarily exhibit such advantages to fall within the scope of the disclosure. Accordingly, embodiments of the disclosure are not limited except as by the appended claims.

I claim:

1. A buoyancy controlled underwater vessel, comprising:

a body having a compressibility less than that of a liquid medium into which the vessel is to be deployed; and a compressibility compensation system comprising a flexible, pliable container carried by the body and a volume of silicone material at least partially filling the pliable container, wherein the pliable container is configured to be submerged in the liquid medium.

2. The underwater vessel of claim 1 wherein the silicone material comprises a polydimethylsiloxane (PDMS) silicone liquid.

3. The underwater vessel of claim 1 wherein the silicone material comprises hexamethyldisiloxane (HMDS).

4. The underwater vessel of claim 1 wherein the silicone material has a higher thermal expansion than water.

5. The underwater vessel of claim 1 wherein the body comprises:

a first portion configured to be pressurized; and a second portion separated from the first portion and configured to be flooded with the liquid medium, and wherein the pliable container is positioned within the second portion.

6. The underwater vessel of claim 1 wherein the pliable container is carried by an external surface of the body.

7. An underwater vessel, comprising:

a hull having a compressibility;

a buoyancy control system configured change the buoyancy of the underwater vessel to move the underwater vessel through a body of water; and a compressibility compensation system configured to compensate for mismatches in the compressibility of the hull and that of the body of water into which the underwater vessel is deployed, wherein the compressibility compensation system comprises a container at least partially filled with a silicone material.

8. The underwater vessel of claim 7 wherein the silicone material comprises polydimethylsiloxane (PDMS) silicone liquid.

9. The underwater vessel of claim 7 wherein the body of water has a first thermal expansion coefficient and the silicone material has a second thermal expansion coefficient higher than the first thermal expansion coefficient.

10. The underwater vessel of claim 7 wherein the container comprises a pliable material having an arbitrary shape.

11. The underwater vessel of claim 7 wherein the buoyancy control system comprises:

an internal reservoir, an external hydraulic accumulator; and a pump configured to move a liquid between the internal reservoir and the external hydraulic accumulator to change the buoyancy of the underwater vessel.

12. The underwater vessel of claim 7 wherein the silicone material comprises hexamethyldisiloxane (HMDS).

13. The underwater vessel of claim 7 wherein the compressibility compensation system is configured to passively compensate for mismatches in the compressibility of the hull and that of the body of water into which the underwater vessel is deployed.

14. A method of controlling an underwater vessel deployed in a body of water, the method comprising:

decreasing the buoyancy of the underwater vessel to descend the underwater vessel to a depth within the body of water;

increasing the buoyancy of the underwater vessel to ascend the underwater vessel from the depth; and using a silicone material as part of a compressibility compensation system to change an overall compressibility of the underwater vessel during descent and ascent to be closer to that of the water in which the underwater vessel is deployed.

15. The method of claim 14 wherein using the silicone material as part of the compressibility compensation system comprises:

submerging a pliable container carrying the silicone material in the water, wherein the pliable container is attached to the underwater vessel.

16. The method of claim 14 herein using the silicone material as part of the compressibility compensation system comprises using a polydimethylsiloxane (PDMS) silicone liquid to compensate for compressibility mismatches between the underwater vessel and the water in which the underwater vessel is deployed.

17. The method of claim 14, further comprising using the silicone material to compensate for differences in a thermal expansion of the underwater vessel and that of the water in which the underwater vessel is deployed.

18. The method of claim 14, further comprising flooding a compartment of the underwater vessel with the water in which the underwater vessel is deployed, wherein the compartment comprises a pliable container at least substantially filled with the silicone material.

19. The method of claim 14 wherein:

decreasing the buoyancy of the underwater vessel comprises moving a liquid from a reservoir within a pressurized portion of the underwater vessel to an accumulator outside the pressurized portion; and increasing the buoyancy of the underwater vessel comprises moving the liquid from the accumulator to the reservoir.

20. The method of claim 14 wherein using the silicone material as part of the compressibility compensation system comprises using a hexamethyldisiloxane (HMDS) to compensate for compressibility mismatches between the underwater vessel and the water in which the underwater vessel is deployed.

* * * * *

UNITED STATES PATENT AND TRADEMARK OFFICE

CERTIFICATE OF CORRECTION

PATENT NO. : 8,726,827 B1
APPLICATION NO. : 13/775083
DATED : May 20, 2014
INVENTOR(S) : Charles C. Eriksen It is certified that error appears in the above-identified patent and that said Letters Patent is hereby corrected as shown below:

In the Specification:

In column 2, line 20, delete “disclosure” and insert -- disclosure. --, therefor.

In column 4, line 25, delete “(PMDSs)” and insert -- (PDMSs) --, therefor.

In column 4, line 29, delete “PMDS” and insert -- PDMS --, therefor.

In column 4, line 29, delete “hexamethyldisloxane” and insert -- hexamethyldisiloxane --, therefor.

In the Claims:

In column 10, line 21, in claim 16, delete “herein” and insert -- wherein --, therefor.

Signed and Sealed this
Fourteenth Day of October, 2014

Michelle K. Lee

Michelle K. Lee
*Deputy Director of the United States Patent and Trademark Office*